US009718640B2

(12) United States Patent
Burner et al.

(10) Patent No.: US 9,718,640 B2
(45) Date of Patent: Aug. 1, 2017

(54) RETRACTABLE BADGE REEL WITH BUTTON DISPLAY

(71) Applicant: Buttonsmith Inc., Carnation, WA (US)

(72) Inventors: Darcy Burner, Redmond, WA (US); Henry Burner, Redmond, WA (US); Michael Burner, Redmond, WA (US)

(73) Assignee: BUTTONSMITH INC., Carnation, WA (US)

( * ) Notice: Subject to any disclaimer, the term of this patent is extended or adjusted under 35 U.S.C. 154(b) by 0 days.

(21) Appl. No.: 15/143,306

(22) Filed: Apr. 29, 2016

(65) Prior Publication Data

US 2017/0022025 A1 Jan. 26, 2017

Related U.S. Application Data

(63) Continuation-in-part of application No. 14/810,221, filed on Jul. 27, 2015, now abandoned.

(60) Provisional application No. 62/046,888, filed on Sep. 5, 2014.

(51) Int. Cl.

| | |
|---|---|
| ***B65H 75/44*** | (2006.01) |
| ***G09F 21/02*** | (2006.01) |
| *G09F 3/20* | (2006.01) |

(52) U.S. Cl.

CPC ..... *B65H 75/44* (2013.01); *G09F 21/02* (2013.01); *G09F 3/207* (2013.01)

(58) Field of Classification Search

CPC ..... A44B 15/005; A45F 5/004; G09F 21/02
See application file for complete search history.

(56) References Cited

U.S. PATENT DOCUMENTS

| | | | |
|---|---|---|---|
| 2,599,660 | A | 6/1952 | Poutinen |
| 3,450,369 | A | 6/1969 | Blanch et al. |
| 3,834,645 | A | 9/1974 | Morishige |
| 3,968,670 | A | 7/1976 | Quenot |
| 4,373,824 | A | 2/1983 | Olsen |
| 4,417,703 | A | 11/1983 | Weinhold |
| 4,596,365 | A | 6/1986 | Wang |
| 4,854,522 | A | 8/1989 | Brown et al. |
| 4,946,010 | A | 8/1990 | DiBono |
| 5,174,625 | A | 12/1992 | Gothier |
| 5,265,823 | A | 11/1993 | Doty |
| 5,400,521 | A | 3/1995 | Waldherr |
| 5,400,625 | A | 3/1995 | Embry |
| 5,509,616 | A | 4/1996 | Millen et al. |
| 5,513,785 | A | 5/1996 | Campagna, Jr. |
| 5,535,960 | A | 7/1996 | Skowronski et al. |
| 5,645,239 | A | 7/1997 | Zwayer et al. |
| 5,697,572 | A | 12/1997 | Salentine et al. |
| 5,815,873 | A | 10/1998 | Jones |
| 5,833,165 | A | 11/1998 | Paugh |
| 5,898,472 | A | 4/1999 | Oshikawa |
| 5,954,288 | A | 9/1999 | Shih |
| 6,019,198 | A | 2/2000 | Nielsen |
| 6,019,304 | A | 2/2000 | Skowronski et al. |
| 6,073,875 | A | 6/2000 | Paugh |

(Continued)

*Primary Examiner* — Gary C Hoge
(74) *Attorney, Agent, or Firm* — AEON Law, PLLC; Adam L. K. Philipp; Jonathan E. Olson

(57) ABSTRACT

An assembly in which a button is secured to a badge reel, the assembly comprising a first structure configured to hold the button against a side of the badge reel and a second structure configured to prevent the button from being sheared from the side of the badge reel.

25 Claims, 3 Drawing Sheets

(56) References Cited

U.S. PATENT DOCUMENTS 6,152,395 A 11/2000 Corriveau et al.
6,179,238 B1 1/2001 Phillipps
6,199,784 B1 3/2001 Wang et al.
6,199,785 B1 3/2001 Paugh
6,250,578 B1 6/2001 Manda
6,279,682 B1 8/2001 Feathers
6,290,158 B1 9/2001 Huang
6,293,485 B1 9/2001 Hollowed
6,324,285 B1 11/2001 Dowsett et al.
6,325,665 B1 12/2001 Chung
6,336,607 B1 1/2002 Perrier
6,364,237 B1 * 4/2002 Kagel ..... A45F 5/004 242/371
6,439,490 B1 8/2002 Hwang
6,536,697 B2 3/2003 Tsan
6,591,461 B2 7/2003 Salentine et al.
6,616,080 B1 9/2003 Edwards et al.
6,668,608 B1 12/2003 Derman
6,679,448 B1 1/2004 Carpenter et al.
6,694,922 B2 2/2004 Walter et al.
6,808,138 B2 10/2004 Liao
6,921,040 B2 7/2005 Watari
6,943,866 B2 9/2005 Redd et al.
7,007,882 B2 3/2006 Raia et al.
7,079,279 B2 7/2006 Peterson
7,374,123 B2 5/2008 Han
7,444,724 B1 11/2008 Perler
7,755,483 B2 7/2010 Schmidt
8,141,211 B2 3/2012 Weyer et al.
8,191,815 B2 6/2012 Huang
8,746,519 B2 * 6/2014 Young ..... A45F 5/021 224/162
8,769,799 B2 7/2014 Emmerich
8,776,686 B2 7/2014 Dubois, III
9,129,230 B2 9/2015 Lewis
9,155,375 B2 10/2015 Murrey
9,205,283 B2 12/2015 Miklatzky et al.
9,270,808 B2 2/2016 Chan et al.
2001/0035242 A1 11/2001 Hughes et al.
2003/0042348 A1 3/2003 Salentine et al.
2003/0042648 A1 3/2003 Tsai
2004/0032741 A1 2/2004 Tai
2005/0011982 A1 1/2005 Salentine et al.
2007/0278265 A1 12/2007 Contente
2008/0035778 A1 * 2/2008 Belden ..... A45F 5/004 242/375
2008/0042000 A1 2/2008 Horton
2008/0265082 A1 * 10/2008 Angiuli ..... A45F 5/004 242/400
2008/0283651 A1 * 11/2008 Ito ..... A45F 5/004 242/386
2009/0049666 A1 * 2/2009 Weyer ..... A44B 15/005 24/633
2011/0174852 A1 * 7/2011 Young ..... A45F 5/021 224/268
2015/0223588 A1 * 8/2015 Denittis ..... A45F 5/004 24/298
2016/0044400 A1 2/2016 Desautels et al.

* cited by examiner

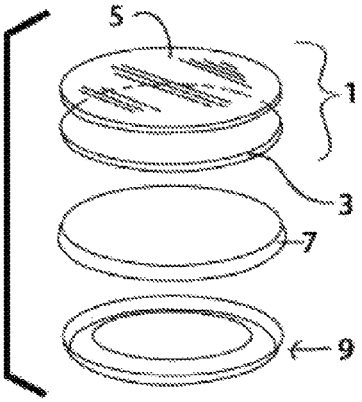
FIG 1
PRIOR ART
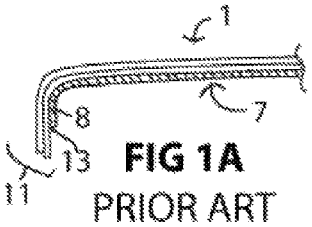
FIG 1A
PRIOR ART
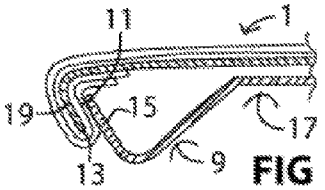
FIG 1B
PRIOR ART
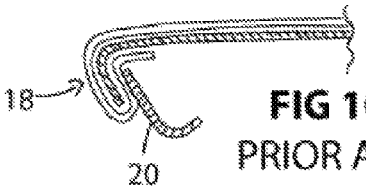
FIG 1C
PRIOR ART
FIG 2
PRIOR ART
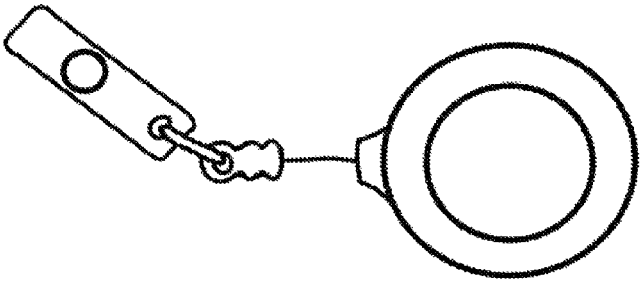

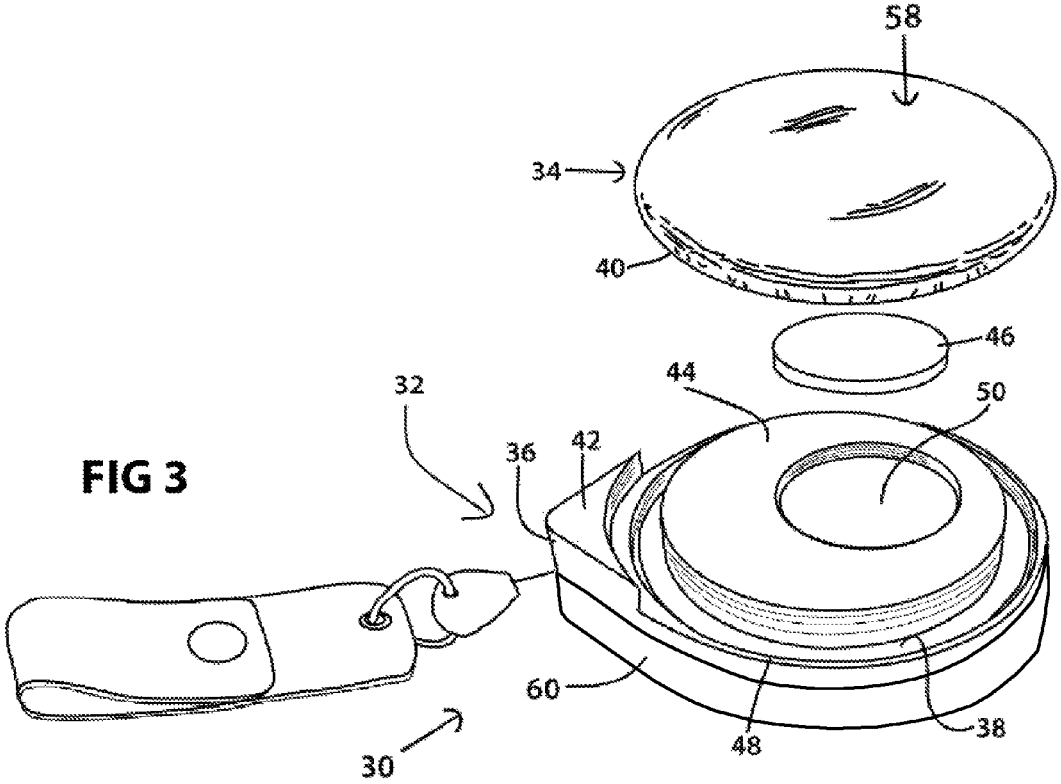
FIG 3
FIG 4
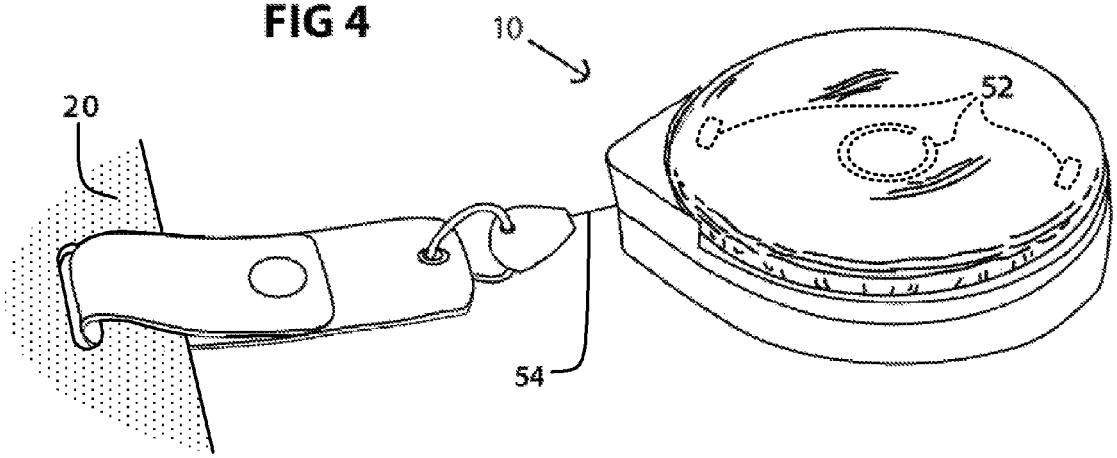

RETRACTABLE BADGE REEL WITH BUTTON DISPLAY

FIELD

This disclosure relates to a retractable badge reel, and more specifically to such a badge reel incorporating a button as a display member.

BACKGROUND

Many individuals are required to carry badges containing identifying information, which they are required to slide or "swipe" through or near a stationary sensing device for security purposes. A common way to carry such a badge is attached to a retractable badge reel, with a clip on its backside for securing the badge reel to the wearer, a retractable cord attached to a bob which is attached to a badge holding strap, and the face side of the reel (opposite the clip side) either plain or with logos, pictorial displays, or the like. Devices of this general type are shown in U.S. Pat. No. 6,364,237 ("Retractable badgeholder with spinning display"); U.S. Pat. No. 6,290,158 ("Reel device carried on one's person"); U.S. Pat. No. 6,073,875 ("Retraction reel for keys and the like"); U.S. Pat. No. 5,833,165 ("Retraction reel for keys and the like"); U.S. Pat. No. 5,815,873 ("Retractable golf utility device"); and U.S. Pat. No. 3,968,670 ("Security key-ring").

U.S. Pat. No. 6,290,158 ("Reel device carried on one's person") describes a reel device having a housing made up of an upper lid and a bottom lid. The upper lid has a hole designed for receiving a decorative piece, which can be sized and shaped to match the hole or can be made of a pad that is sandwiched between the upper lid and a lining sleeve that sits atop the reel interior. To achieve a decorative design on the face of the reel, the upper lid and decorative piece must be installed to cover over the central hole through which a rivet passes, holding the reel together. The presence of the rivet extending through the central hole makes the imprinting of the lining sleeve so as to have the face of the lining sleeve be the visible outer face of the housing undesirable. In this fashion, the reel device requires a multitude of components to achieve a decorative marking. Further, there is no teaching that the decorative piece or the upper lid is removable to allow for changing of the decorative element once the reel has been assembled.

U.S. Pat. No. 7,007,882 ("Retractable badge reel with billboard display") describes a retractable badge reel with a billboard that can be independently embossed, painted, or silkscreened, allowing the artwork to be produced separately from the badge reel. However, it contemplates only conventional methods for transferring the artwork onto the billboard, including pad printing and silkscreening, which limit artwork to a small number of colors and require that it be produced in large quantities using specialized printing equipment.

Prior buttons are typically a novelty item, and are known by a variety of names, sometimes called a "campaign button" or "pin."

BRIEF DESCRIPTION OF THE DRAWINGS

FIG. 1 illustrates an exploded perspective view of a prior button.

FIG. 1A illustrates a partial cross sectional view of a prior button shown in a partial assembled condition.

FIG. 1B illustrates a partial cross sectional view of the button of FIG. 1A, but showing the button in a fully assembled condition.

FIG. 1C illustrates a view similar to FIG. 1B, but showing a button made with a collet.

FIG. 2 illustrates a view of a prior badge reel.

FIG. 3 illustrates an exploded view of the badge reel with button attachment apparatus and button.

FIG. 4 illustrates a perspective view of the badge reel with the button attached.

DETAILED DESCRIPTION

Figure 5:
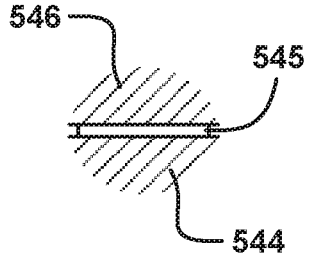
FIG. 5 illustrates a magnet mounted with an adhesive.

The phrases "in one embodiment," "in various embodiments," "in some embodiments," and the like are used repeatedly. Such phrases do not necessarily refer to the same embodiment. The terms "comprising," "having," and "including" are synonymous, unless the context dictates otherwise. Such terms do not generally signify a closed list.

"Above," "adhesive," "affixing," "any," "around," "both," "bottom," "by," "comprising," "consistent," "customized," "enclosing," "friction," "in," "labeled," "lower," "magnetic," "marked," "new," "nominal," "not," "of," "other," "outside," "outwardly," "particular," "permanently," "preventing," "raised," "respectively," "reversibly," "round," "square," "substantial," "supporting," "surrounded," "surrounding," "threaded," "to," "top," "using," "wherein," "with," or other such descriptors herein are used in their normal yes-or-no sense, not as terms of degree, unless context dictates otherwise.

Reference is now made in detail to the description of the embodiments as illustrated in the drawings. While embodiments are described in connection with the drawings and related descriptions, there is no intent to limit the scope to the embodiments disclosed herein. On the contrary, the intent is to cover all alternatives, modifications and equivalents. In alternate embodiments, additional devices, or combinations of illustrated devices, may be added to, or combined, without limiting the scope to the embodiments disclosed herein.

A typical button is assembled with a flexible laminate 1, which normally includes a sheet of artwork 3 and a protective transparent film 5, and is overlaid on a domed shell 7 having an annular wall 8. However, it is not necessary that the artwork 3 and transparent film 5 be bonded to each other. The term "laminate" includes artwork and transparent films that are both separated pieces and bonded pieces. The laminate 1 has a skirt portion 11 that overhangs the free edge 13 of the shell wall 8. A formed back 9, which is usually made of steel, is placed against the shell in a manner that tucks the skirt 11 of the laminate around the free edge 13 of the shell wall. The shell wall is crimped around its free edge against an outer frusto-conical wall 15 of the back 9, thereby bending the wall 8 of the shell and assembling the button 17. The finished button 17 has a three dimensional appearance that enhances the visual appeal of the artwork 3.

It will be noticed that the shell wall 8 has become frusto-conical in shape, as is shown at reference numeral 19 in FIG. 1B, and also that the laminate skirt 11 is tucked between the shell wall 19 and the back wall 15. Those two structural features are characteristic of buttons. FIG. 1C shows a typical prior button 18 that is made in a similar fashion with a collet 20 instead of a formed back 9.

FIG. 2 illustrates a view of a prior badge reel.

Referring now to FIG. 3, there is shown a badge reel 30 with at least a first button attachment apparatus 32, a first button 34 having a marked top face 58, and one or more optional features described below. It deserves emphasis that FIG. 3 merely exemplifies the invention which may be embodied in other specific structures. While a particular embodiment has been depicted in FIG. 3, many important features may be changed without departing from the spirit and scope of the invention, which is defined by the clauses and claims presented below. In some variants, for example, a second (instance of) button attachment apparatus 32 may secure a second button 34 to an opposite side of badge reel 30. Alternatively or additionally, each marked top face 58 may include one or more distinctive symbols or end-user-selected colors or patterns visible thereon.

As shown, button attachment apparatus 32 is incorporated into badge reel top 36 and includes a channel 38 to enclose button lower edge 40; raised sections 42 and 44 to prevent shearing of button 34 from badge reel 30; and a perimeter 48 as described below. The manufacturer or end user can attach button 34 to badge reel 30 by attaching one or more magnets 46 to or within badge reel 30 and using magnetism to attract button 34. This can occur, for example, in a context in which button 34 comprises a substantial component of iron (at least 20% by weight, e.g.) or one or more other ferromagnetic components. Alternatively or additionally, such magnet(s) may be inserted into one or more corresponding recesses 50 in raised section 44 or permanently affixed (by adhesion or integral formation, e.g.) thereto.

Referring now to FIG. 4, there is shown a perspective view of the customized badge reel assembly 10. As shown, a spring-retractable cord 54 configured to support a badge 20 extends out of badge reel 30 and first button 34 is attached. Various fasteners 52 (clips or adhesions as described below, e.g.) may be configured to achieve this attachment, the operation of which is described below. The outer fasteners 52 as shown may be implemented as clips extending from the perimeter 48 of the badge reel.

In light of teachings herein, numerous existing techniques may be applied for configuring personalized buttons and customization features as described herein without undue experimentation. See, e.g., U.S. Pat. No. 9,270,808 ("Customized hardware selection for a mobile phone"); U.S. Pat. No. 9,205,283 ("Systems for custom coloration"); U.S. Pat. No. 9,155,375 ("Customizable attachable article with integrated pocket and beverage container kit"); U.S. Pat. No. 9,129,230 ("Virtual badge, device and method"); U.S. Pat. No. 8,776,686 ("Automated cutting system for customized field stencils"); U.S. Pat. No. 8,769,799 ("Self locking fasteners and methods relating to same"); U.S. Pat. No. 8,141,211 ("Button engaging and attachment apparatus and methods related applications"); U.S. Pat. No. 7,444,724 ("Lace securing apparatus"); U.S. Pat. No. 7,079,279 ("Methods and apparatus for producing a lenticular novelty item at a point of purchase"); U.S. Pat. No. 6,943,866 ("Image prints having customized backprinting message"); U.S. Pat. Pub. No. 2016/0044400 ("Adhesivelessly customizable containment of a delicate electrical apparatus such as earbuds"); and U.S. Pat. Pub. No. 2009/0049666 ("Button engaging and attachment apparatus and methods related applications").

In light of teachings herein, numerous existing techniques may be applied for configuring badge reels or other such support structures as described herein without undue experimentation. See, e.g., U.S. Pat. No. 8,746,519 ("Releasable attachment apparatus"); U.S. Pat. No. 8,191,815 ("Auto-reversible reel"); U.S. Pat. No. 7,755,483 ("Article holding and tracking device"); U.S. Pat. No. 7,374,123 ("Rewind mechanism"); U.S. Pat. No. 7,007,882 ("Retractable badge reel with billboard display"); U.S. Pat. No. 6,921,040 ("Windup type storage container"); U.S. Pat. No. 6,808,138 ("Wire-winding box structure with increased use area"); U.S. Pat. No. 6,694,922 ("Retractable leash assembly"); U.S. Pat. No. 6,679,448 ("Handset cable reel"); U.S. Pat. No. 6,668,608 ("Valet key ring holder"); U.S. Pat. No. 6,616,080 ("Retractable cord device"); U.S. Pat. No. 6,591,461 ("Connector with strain relief"); U.S. Pat. No. 6,536,697 ("Structure of automatic suspender reeling device"); U.S. Pat. No. 6,439,490 ("Wire reeler"); U.S. Pat. No. 6,336,607 ("Kite line reeler and controller"); U.S. Pat. No. 6,325,665 ("Power adapter with cable storage device"); U.S. Pat. No. 6,324,285 ("Cradle for a handset"); U.S. Pat. No. 6,293,485 ("Two-stage retractable cord reel"); U.S. Pat. No. 6,279,682 ("Speed responsive coupling device especially for fall arrest apparatus"); U.S. Pat. No. 6,250,578 ("Cable winding housing"); U.S. Pat. No. 6,199,785 ("Ratchet mechanism for a reel"); U.S. Pat. No. 6,199,784 ("Automatically rewindable wire device"); U.S. Pat. No. 6,179,238 ("Reel device"); U.S. Pat. No. 6,152,395 ("Spool assembly for pintle"); U.S. Pat. No. 6,019,304 ("Retractable reel with channeled ratchet mechanism"); U.S. Pat. No. 6,019,198 ("Mechanically driven ratchet assembly"); U.S. Pat. No. 5,954,288 ("Extensible hanging device"); U.S. Pat. No. 5,898,472 ("Automatic eyewear strap winding device"); U.S. Pat. No. 5,697,572 ("Retractable holder"); U.S. Pat. No. 5,645,239 ("Fishing reel anti-reverse system with dual-purpose actuator switch"); U.S. Pat. No. 5,535,960 ("Cord reel assembly"); U.S. Pat. No. 5,513,785 ("Gun retention system"); U.S. Pat. No. 5,509,616 ("Retractable chalk line device"); U.S. Pat. No. 5,400,625 ("Locking key ring"); U.S. Pat. No. 5,400,521 ("Locking mechanism for retractable tape"); U.S. Pat. No. 5,265,823 ("Tension relieving mechanism for a safety belt system"); U.S. Pat. No. 5,174,625 ("Lever-operated locking and brake means for a tarp cover system"); U.S. Pat. No. 4,946,010 ("Telephone cord retraction device"); U.S. Pat. No. 4,854,522 ("Safety apparatus"); U.S. Pat. No. 4,596,365 ("Spool means used in flying a kite"); U.S. Pat. No. 4,417,703 ("Quick retrieve cord reel"); U.S. Pat. No. 4,373,824 ("Ribbon tension and metering control"); U.S. Pat. No. 3,968,670 ("Security key-ring"); U.S. Pat. No. 3,834,645 ("Cord winding device"); U.S. Pat. No. 3,450,369 ("Reel construction having pawl optionally mounted"); U.S. Pat. No. 2,599,660 ("Quick disconnect key holder"); U.S. Pat. Pub. No. 2008/0283651 ("Hanging device"); U.S. Pat. Pub. No. 2008/0042000 ("Universal Retractable Zip Clip"); U.S. Pat. Pub. No. 2007/0278265 ("System for carrying portable device"); U.S. Pat. Pub. No. 2005/0011982 ("Tethering system for personal electronic devices"); U.S. Pat. Pub. No. 2004/0032741 ("Lamp reel"); U.S. Pat. Pub. No. 2003/0042648 ("Method for manufacturing integrated forming shoe inserts"); U.S. Pat. Pub. No. 2003/0042348 ("Retracting tether for cell phones, pagers & PDA's"); and U.S. Pat. Pub. No. 2001/0035242 ("Integrated headset-case for wireless phones").

Referring now to FIG. 5, there is shown generically a magnet 546 in cross section that may be permanently affixed to a raised section 544 of the housing by adhesive 545 (as a fastener).

In the numbered clauses below, specific combinations of aspects and embodiments are articulated in a shorthand form such that (1) according to respective embodiments, for each instance in which a "component" or other such identifiers appear to be introduced (with "a" or "an," e.g.) more than once in a given chain of clauses, such designations may either identify the same entity or distinct entities; and (2) what might be called "dependent" clauses below may or may not incorporate, in respective embodiments, the features of "independent" clauses to which they refer or other features described above.

Those skilled in the art will appreciate that the foregoing specific exemplary processes and/or devices and/or technologies are representative of more general processes and/or devices and/or technologies taught elsewhere herein, such as in the claims filed herewith and/or elsewhere in the present application.

CLAUSES

Clause 1. (Independent) A customized badge reel assembly 10 comprising:

a labeled button 34 having a marked top face 58 and a bottom edge 40; and a badge reel 30 having a spring-retractable cord 54 configured to support a badge 20, a housing 60 of the badge reel 30 having an annular channel 38 configured to enclose the bottom edge 40 of the labeled button 34 with the housing 60 supporting the labeled button 34, the housing 60 of the badge reel 30 also having one or more raised sections configured to prevent the labeled button 34 from shearing off the badge reel 30 during use, and a fastener 52 to affix the labeled button 34 with the badge reel 30 so that the marked top face 58 of the labeled button 34 customizes the badge reel assembly 10.

CLAUSE 2. The customized badge reel assembly of CLAUSE 1, wherein the badge reel 30 and the button 34 are both (as shown, nominally) round.

CLAUSE 3. The customized badge reel assembly of CLAUSE 1, wherein the badge reel 30 and the button 34 are both nominally square.

CLAUSE 4. The customized badge reel assembly of ANY OF THE ABOVE CLAUSES, wherein at least one of the raised sections 42 of the housing 60 is outside the button lower edge 40.

CLAUSE 5. The customized badge reel assembly of ANY OF THE ABOVE CLAUSES, wherein at least one of the raised sections 44 of the housing 60 is surrounded by the button lower edge 40.

CLAUSE 6. The customized badge reel assembly of ANY OF THE ABOVE CLAUSES, wherein the button 34 is permanently adhered to the badge reel 30 by at least one non-magnetic fastener 52 comprising an adhesive.

CLAUSE 7. The customized badge reel assembly of ANY OF THE ABOVE CLAUSES, wherein the button 34 is permanently attached to the badge reel 30 using one or more adhesions (as fasteners 52, e.g.) on at least one of the one or more raised surfaces 44 of the badge reel 30.

CLAUSE 8. The customized badge reel assembly of ANY OF THE ABOVE CLAUSES, wherein the button 34 is permanently attached to the badge reel 30 using one or more adhesions (as fasteners 52, e.g.) in the channel 38 of the badge reel 30.

CLAUSE 9. The customized badge reel assembly of ANY OF THE ABOVE CLAUSES, wherein the button 34 is permanently attached to the badge reel 30 using one or more clips (as fasteners 52, e.g.) extending upward from the badge reel 30 through the button lower edge 40 and wherein the button lower edge forms a hole in the bottom of the button 34.

CLAUSE 10. The customized badge reel assembly of ANY OF THE ABOVE CLAUSES, wherein the button 34 is permanently attached to the badge reel 30 using a combination of external and internal clips (as fasteners 52 respectively outside and inside the button lower edge 40, e.g.) extending upward from the badge reel 30 and securing the button 34.

CLAUSE 11. The customized badge reel assembly of ANY OF CLAUSES 1-5, wherein the button 34 is reversibly attached to the badge reel 30 through a threaded engagement with a (nominally) cylindrical raised section 42 of the badge reel 30.

CLAUSE 12. The customized badge reel assembly of ANY OF CLAUSES 1-5 OR 11, wherein the button 34 is reversibly attached to the badge reel 30 through a friction fit of the button 34 exerted inwardly upon a cylindrical raised section 42 of the badge reel 30.

CLAUSE 13. The customized badge reel assembly of ANY OF CLAUSES 1-5 OR 11-12, wherein the button 34 is reversibly attached to the badge reel 30 by a friction fit of the button 34 exerted outwardly upon the perimeter 48 of the channel 38.

CLAUSE 14. The customized badge reel assembly of ANY OF CLAUSES 1-5 OR 11-13, wherein the button 34 is reversibly attached to the badge reel 30 by a plurality of clips extending from the perimeter 48 of the badge reel 30 around the button lower edge 40.

CLAUSE 15. The customized badge reel assembly of ANY OF CLAUSES 1-5 OR 11-14, wherein the button 34 is reversibly affixed to the badge reel 30 by at least one non-magnetic fastener 52 comprising an internal clip, surrounded by the button lower edge 40.

CLAUSE 16. The customized badge reel assembly of ANY OF CLAUSES 1-5 OR 11-15, wherein the button 34 is reversibly affixed to the badge reel 30 by at least one non-magnetic fastener 52 comprising an external clip, not surrounded by the button lower edge 40.

CLAUSE 17. The customized badge reel assembly of ANY OF CLAUSES 1-5 OR 11-16, wherein the button 34 includes a substantial component of iron and wherein one or more magnets 46 are affixed to the badge reel top 36 and configured to attract and reversibly attach to the button 34.

CLAUSE 18. The customized badge reel assembly of ANY OF CLAUSES 1-5 OR 11-17, wherein the button 34 includes a substantial component of iron and wherein one or more magnets 46 are situated in one or more recesses 50 of the badge reel top 36 and configured to attract and reversibly attach to the button 34.

CLAUSE 19. The customized badge reel assembly of ANY OF CLAUSES 1-5 OR 11-16, wherein the button 34 is affixed to the badge reel 30 by at least one non-magnetic fastener 52 without any magnets supporting the badge reel 30.

All of the patents and other publications referred to above are incorporated herein by reference generally—including those identified in relation to particular new applications of existing techniques—to the extent not inconsistent herewith (in each respective latest edition, where applicable). While various systems, methods, articles of manufacture, or other embodiments or aspects have been disclosed above, also, other combinations of embodiments or aspects will be apparent to those skilled in the art in view of the above disclosure. The various embodiments and aspects disclosed above are for purposes of illustration and are not intended to be limiting, with the true scope and spirit being indicated in the final claim set that follows.

What is claimed is:

1. A customized badge reel assembly comprising:

a labeled button having a marked top face and a bottom edge; and a badge reel having a spring-retractable cord configured to support a badge, a housing of the badge reel having an annular channel configured to enclose the bottom edge of the labeled button with the housing supporting the labeled button, the housing of the badge reel also having one or more raised sections configured to prevent the labeled button from shearing off the badge reel during use, and a fastener to affix the labeled button with the badge reel so that the marked top face of the labeled button customizes the badge reel assembly, wherein the button is reversibly attached to the badge reel through a first friction fit of the button exerted inwardly upon a cylindrical raised section of the badge reel, wherein the button is also reversibly attached to the badge reel by a second friction fit of the button exerted outwardly upon the perimeter of the channel, and wherein the button is also reversibly attached to the housing of the badge reel by a plurality of clips extending from the perimeter of the badge reel around the button lower edge so that activation of the spring-retractable cord does not cause the button to rotate.

2. The customized badge reel assembly of claim 1, wherein the badge reel and the button are both (nominally) round.

3. The customized badge reel assembly of claim 1, wherein at least a first one of the raised sections of the housing is outside the button lower edge.

4. The customized badge reel assembly of claim 3, wherein at least a second one of the raised sections of the housing is surrounded by the button lower edge.

5. The customized badge reel assembly of claim 1, wherein the button is reversibly affixed to the badge reel by at least one non-magnetic fastener comprising an internal clip of the plurality of clips, surrounded by the button lower edge.

6. The customized badge reel assembly of claim 1, wherein the button includes a substantial component of iron and wherein one or more magnets are situated in one or more recesses of the badge reel top and configured to attract and reversibly attach to the button.

7. A customized badge reel assembly comprising:

a labeled button having a marked top face and a bottom edge; and a badge reel having a spring-retractable cord configured to support a badge, a housing of the badge reel having an annular channel configured to enclose the bottom edge of the labeled button with the housing supporting the labeled button, the housing of the badge reel also having one or more raised sections configured to prevent the labeled button from shearing off the badge reel during use, and a fastener to affix the labeled button with the housing of the badge reel so that the marked top face of the labeled button customizes the badge reel assembly and so that activation of the spring-retractable cord does not cause the button to rotate.

8. The customized badge reel assembly of claim 7, wherein at least one of the raised sections of the housing is outside the button lower edge.

9. The customized badge reel assembly of claim 7, wherein at least one of the raised sections of the housing is surrounded by the button lower edge.

10. The customized badge reel assembly of claim 7, wherein the button is permanently adhered to the badge reel by at least one non-magnetic fastener comprising an adhesive.

11. The customized badge reel assembly of claim 7, wherein the button is permanently attached to the badge reel using one or more adhesions on at least one of the one or more raised surfaces of the badge reel.

12. The customized badge reel assembly of claim 7, wherein the button is permanently attached to the badge reel using one or more clips extending upward from the badge reel through the button lower edge and wherein the button lower edge forms a hole in the bottom of the button.

13. The customized badge reel assembly of claim 7, wherein the button is reversibly attached to the badge reel through a friction fit of the button exerted inwardly upon a cylindrical raised section of the badge reel.

14. The customized badge reel assembly of claim 7, wherein the button is reversibly attached to the badge reel by a friction fit of the button exerted outwardly upon the perimeter of the channel.

15. The customized badge reel assembly of claim 7, wherein the button is reversibly attached to the badge reel by a plurality of clips extending from the perimeter of the badge reel around the button lower edge.

16. The customized badge reel assembly of claim 7, wherein the button is reversibly affixed to the badge reel by at least one non-magnetic fastener comprising an internal clip, surrounded by the button lower edge.

17. The customized badge reel assembly of claim 7, wherein the button includes a substantial component of a ferromagnetic material and wherein one or more magnets are affixed to the badge reel top and configured to attract and reversibly attach to the button.

18. The customized badge reel assembly of claim 7, wherein the button includes a substantial component of iron and wherein one or more magnets are situated in one or more recesses of the badge reel top and configured to attract and reversibly attach to the button.

19. The customized badge reel assembly of claim 7, wherein the button includes a substantial component of iron and wherein the badge reel top is configured to attract magnetically and reversibly attach to the button.

20. The customized badge reel assembly of claim 7, wherein the button is reversibly attached to the badge reel by a plurality of clips extending from the perimeter of the badge reel around the button lower edge.

21. A customized badge reel assembly comprising:

a labeled button having a marked top face and a bottom edge; and a badge reel having a spring-retractable cord configured to support a badge, a housing of the badge reel having an annular channel configured to enclose the bottom edge of the labeled button with the housing supporting the labeled button, the housing of the badge reel also having one or more raised sections configured to prevent the labeled button from shearing off the badge reel during use, and a first friction fit to affix the labeled button with the housing of the badge reel so that the marked top face of the labeled button customizes the badge reel assembly.

22. The customized badge reel assembly of claim 21, wherein the button is reversibly attached to the badge reel through the first friction fit.

23. The customized badge reel assembly of claim 21, wherein the first friction fit of the button is exerted inwardly upon a cylindrical raised section of the badge reel.

24. The customized badge reel assembly of claim 21, wherein the first friction fit of the button is exerted outwardly upon the perimeter of the channel.

25. The customized badge reel assembly of claim 22, wherein the button is also attached to the badge reel by a second friction fit of the button exerted inwardly upon a cylindrical raised section of the badge reel.

* * * * *